United States Patent [19]

Toole

[11] 4,382,560

[45] May 10, 1983

[54] ROCK CRUSHING MACHINE WITH DUAL CAM SHAFT JAW DRIVING MECHANISM

[76] Inventor: Nicolle A. Toole, 1235 SW. 2nd Ave., Ontario, Oreg. 97914

[21] Appl. No.: 198,307

[22] Filed: Oct. 20, 1980

Related U.S. Application Data

[63] Continuation-in-part of Ser. No. 5,726, Jan. 23, 1979, Pat. No. 4,248,390.

[51] Int. Cl.[3] ..... B02C 9/00

[52] U.S. Cl. ..... 241/101.2; 241/263; 241/264

[58] Field of Search ..... 241/262–269, 241/101.2; 74/25, 22 R, 86

[56] References Cited

U.S. PATENT DOCUMENTS

| | | | |
|---|---|---|---|
| 2,177,524 | 10/1939 | Gruender . | |
| 2,487,744 | 11/1949 | Waters . | |
| 2,505,132 | 4/1950 | Meinhardt . | |
| 2,588,180 | 3/1952 | Traylor, Jr. . | |
| 2,605,051 | 7/1952 | Bogle | 241/264 X |
| 2,626,759 | 1/1953 | Barber et al. . | |
| 2,701,107 | 2/1955 | Johnson . | |
| 2,737,349 | 3/1956 | Hicker . | |
| 2,998,936 | 9/1961 | Gruender . | |
| 3,001,729 | 9/1961 | Conway . | |
| 3,145,938 | 8/1964 | Pollitz . | |
| 3,211,388 | 10/1965 | Gartner . | |
| 4,027,354 | 6/1977 | Burpee | 74/25 X |

OTHER PUBLICATIONS

Smith Engineering Works, Telesmith's *New* Jaw Crushers, 10/20/80.

*Primary Examiner*—Mark Rosenbaum
*Assistant Examiner*—Timothy V. Eley
*Attorney, Agent, or Firm*—Klarquist, Sparkman, Campbell, Leigh, Whinston & Dellett

[57] ABSTRACT

A rock crusher includes a dual cam shaft drive mechanism for imparting substantially linear motion to a movable jaw between a pair of fixed jaws. A driven cam shaft coupled to the movable jaw cooperates with another cam shaft also coupled to the jaw to impart this motion to the jaw. In one embodiment, the maximum eccentricity of the driven cam shaft is less than the maximum eccentricity of the other cam shaft so that the other cam shaft oscillates and imparts the desired motion to the movable jaw. In another embodiment, the cam shafts have the same maximum eccentricity and are synchronized to move together, such as by gears, during crushing.

16 Claims, 7 Drawing Figures

ROCK CRUSHING MACHINE WITH DUAL CAM SHAFT JAW DRIVING MECHANISM

CROSS REFERENCE TO RELATED APPLICATIONS

This application is a continuation-in-part application of my co-pending application Ser. No. 5,726, filed Jan. 23, 1979, now U.S. Pat. No. 4,248,390, for my invention entitled "Rock Crushing Machine with Rotary Eccentric Jaw Driving Mechanism".

BACKGROUND OF THE INVENTION

1. Field of the Invention

The present invention relates to rock crushers having a drive mechanism for moving a movable jaw toward a single fixed jaw or between a pair of fixed jaws.

2. Description of the Prior Art

It is preferable in movable jaw type rock crushers to have the jaw move as nearly linearly as possible between a pair of stationary jaws. This is because the greatest crushing efficiency is achieved by linear motion of one jaw relative to the other, in constrast to orbital motion. Furthermore, because most crushing takes place between the lower ends of the movable and fixed jaws, it is particularly desirable that the motion of the jaw be substantially linear in that region.

Heretofore, drive mechanism employing a single cam have been utilized to impart motion to the movable jaw of a crusher. However, as typified by U.S. Pat. No. 2,737,349, such mechanisms commonly impart an orbital motion to the movable jaw. Consequently, the efficiency of such devices in crushing materials is impaired. Furthermore, such crushers often utilize mechanical links (such as link arms or toggle plates) either for supporting the movable jaw or as part of the drive mechanism. Due to the unusually high stresses associated with rock crushing operations, mechanical links of this type are subject to wear and breakage. When this occurs, the crusher is often inoperative for a substantial period of time, at great cost and lost productivity, while repairs are made.

In another known type crusher, as exemplified by U.S. Pat. Nos. 2,177,524 and 2,487,744, a complex revolving cam drive assembly slides against friction or wear pads during at least a portion of rotation of the cam. During each revolution of the cam, a portion of the motion of the cam, usually a portion of the vertical component of its motion, is not transferred to the movable jaw. In addition to frequent time consuming replacement of worn out friction pads, more energy is required to drive such devices to overcome the friction between the drive mechanism and the pads.

Still another form of rock crusher is illustrated in U.S. Pat. No. 3,145,938. The drive mechanism of this prior art device includes an eccentric positioned toward the top of a movable jaw. A mechanical link coupled between the framework of the crusher and a lower portion of the jaw slides relative to a pin on the jaw. Because of this sliding motion, a portion of the vertical component of motion that would be otherwise imparted to the jaw by the eccentric is lost. Although the lower portion of the movable jaw of this device apparently moves back and forth along a line approximately forty-five degrees from horizontal, the motion of the upper and mid portions of the jaw is orbital as in other prior art crushers. Also, such a crusher suffers from the disadvantages associated with devices having mechanical links in that these links are subject to failure. Furthermore, sliding mechanical links of this type tend to rapidly wear, particularly when grit produced during crushing lodges between the sliding link and pin.

U.S. Pat. No. 2,505,132 discloses still another rock crusher utilizing an eccentric cam type drive mechanism. This device utilizes a link 28 to transmit motion from the drive mechanism to the movable jaw and hence suffers from the drawbacks mentioned above.

Therefore, a need exists for a relatively trouble free and mechanically simple rock crusher having a drive mechanism capable of imparting substantially linear motion to a movable jaw between a pair of fixed jaws.

SUMMARY OF THE INVENTION

The present invention overcomes the foregoing problems by providing a dual cam shaft drive mechanism in a crusher. More specifically, such a drive mechanism includes a first driven cam shaft and a second cam shaft each of which passes through a respective circular yoke in the movable jaw. These cam shafts cooperate with one another for imparting substantially linear motion, as opposed to orbital motion, to the jaw.

As a more specific feature of one embodiment of the invention, the second cam shaft is not driven and has a maximum eccentricity greater than the maximum eccentricity of the first driven cam shaft so that the second cam shaft oscillates to impart the desired motion to the jaw.

As a feature of another embodiment of the invention, the cam shafts each have the same maximum eccentricity and are synchronized, such as by a gear mechanism, so that they cooperate to impart crushing motion to the entire movable jaw.

A primary object of the invention is to provide a rock crusher having an improved drive mechanism.

Another object of the invention is to provide a rock crusher with an improved drive mechanism which imparts substantially linear motion to a movable jaw toward and away from a single fixed jaw or between a pair of fixed jaws.

A further object of the invention is to provide a rock crusher with such a drive mechanism which is durable and easy to maintain.

Still another object of the invention is to provide a relatively low cost and mechanically simple drive mechanism for a rock crusher.

An additional object is to provide an improved rock crusher which minimizes the number of moving parts.

The foregoing and other objects, features and advantages of the present invention will become more apparent from the following detailed description, which proceeds with reference to the accompanying drawings.

DETAILED DESCRIPTION OF THE PREFERRED EMBODIMENTS

Figure 1:
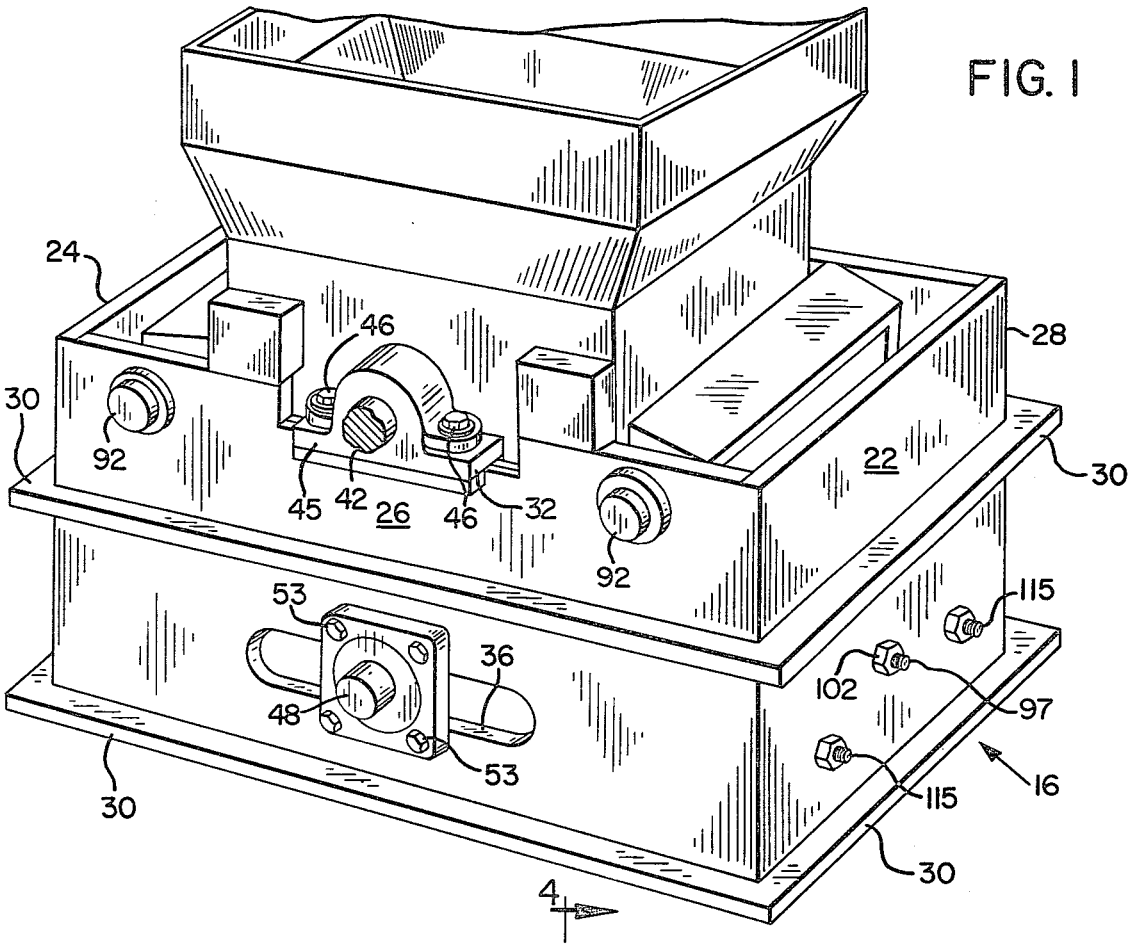
FIG. 1 is a partially broken away front perspective view of a rock crushing apparatus in accordance with the present invention.
Figure 2:
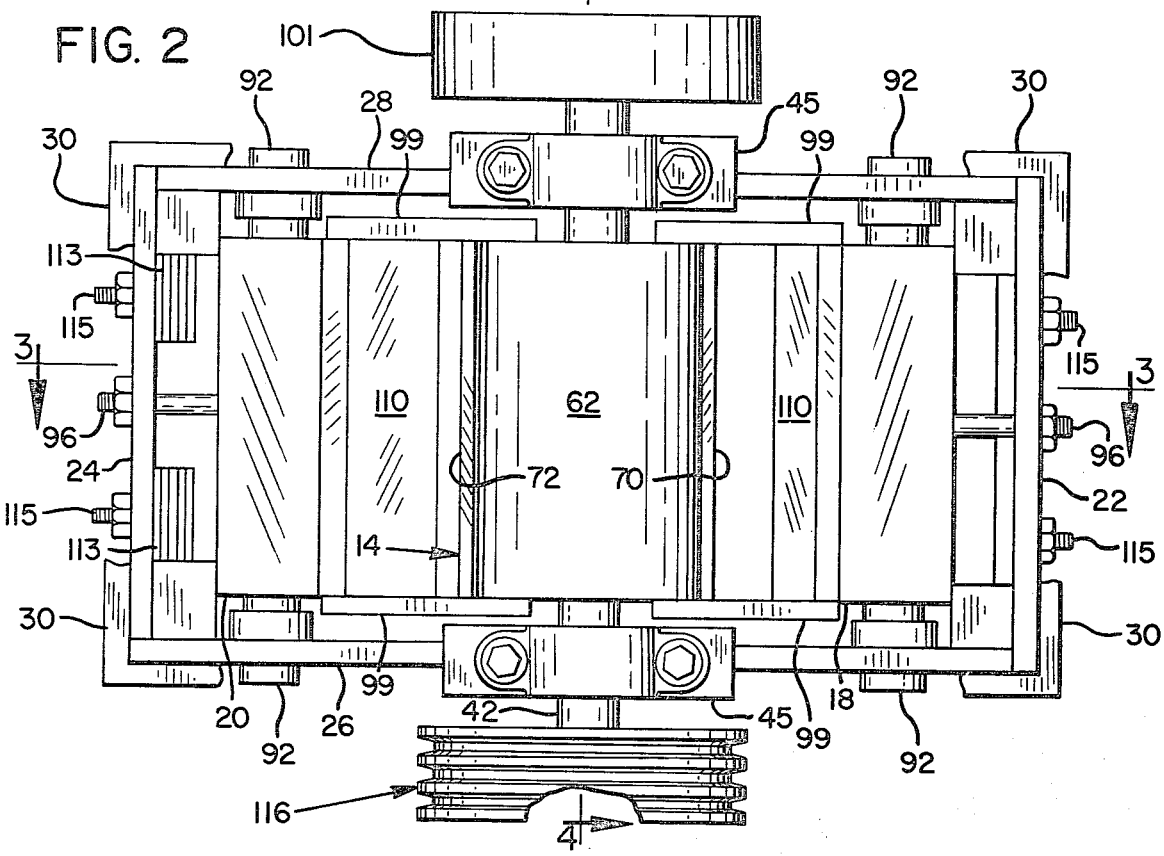
FIG. 2 is a top view of the invention of FIG. 1 with the hopper portion thereof removed for clarity.

Referring to FIGS. 1 and 2, rocks 10 are deposited by an endless conveyor (not shown) into an upwardly opening hopper 12 of a rock crusher in accordance with the invention. A movable jaw 14 supported by a rigid box-like frame 16 is positioned beneath hopper 12 so that rocks falling from the hopper pass between the sides of jaw 14 and a pair of respective stationary jaws 18, 20. A drive mechanism, explained below, causes jaw 14 to reciprocate in a substantially linear direction between the stationary jaws to thereby crush the rock. The crushed rock exits through a discharge opening between the lowermost region of the movable jaw and the respective stationary jaw and from the bottom of frame 16.

Hopper 12 is mounted to the upper end of frame 16 which has side wall panels 22, 24 and upright rigid spaced apart front and rear jaw supporting wall panels or plates 26, 28. Each of the front and rear panels 26, 28 is provided, for purposes set forth below, with a respective upper horizontal drive shaft mounting flange or bracket 32, 34. In addition, as explained in greater detail below, each panel has a central elongated slot 36, 38 having its axis in a horizontal plane. From 16 is preferably of welded steel sheets, cast steel or other strong durable material. The frame includes suitable reinforcing members, such as rib members 30 which encircle the side wall panels 22, 24 and front and rear wall panels 26, 28. Rib members 30 are typically welded or cast to frame 16.

Figure 3:
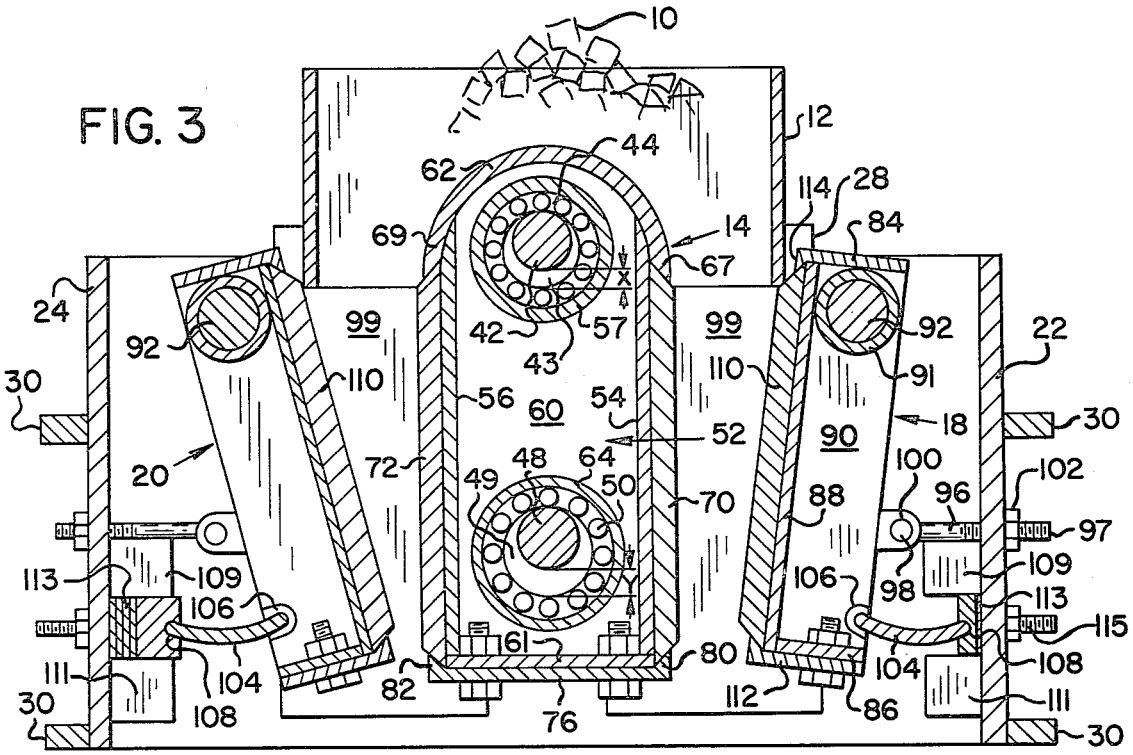
FIG. 3 is a vertical sectional view of the apparatus of the present invention taken along lines 3—3 of FIG. 2.

An upper driven cam shaft 42 (shown in FIG. 4) extends transversely between front and rear plates 26, 28 and is journalled at its respective ends to these plates by roller bearings 44 each retained within a bearing housing 45 secured, as by bolts 46, (FIG. 1) to respective mounting flanges 32, 34 and hence to plates 26, 28. As a result, axial sliding movement of shaft 42 is prevented. Shaft 42 includes a cam means such as camming portion 43 with a maximum eccentricity of X, as shown in FIG. 3.

An oscillating or floating cam shaft means 48 extends transversely between plates 26, 28 below shaft 42. Shaft 48 includes a cam means camming portion 49 with a maximum eccentricity of Y as shown in FIG. 3. Shaft 48 is similarly journalled at its ends to upright plates 26, 28 by roller bearings 50 in respective bearing housings 51 which are secured, as by bolts 53, to the plates. With this construction, loosening of bolts 53 permits removal of bearings 50 and housings 51 by sliding them off the respective ends of shaft 48. In addition, with bearings 50 and their housings 51 removed and bolts 46 removed, slots 36, 38 permit sufficient movement of shaft 48 to position its ends interiorly of front and rear wall panels 26, 28 so that jaw 14 and shaft 48 can be lifted upwardly away from frame 16. Consequently, the jaw and shaft can easily be removed and repaired or replaced, if this becomes necessary.

The maximum eccentricity of the driven shaft 42 is less than the maximum eccentricity of the floating or nondriven shaft 48, that is X is less than Y. Consequently, as shaft 42 is driven in rotation, shaft 48 oscillates and produces a substantially linear crushing action as explained below in connection with FIG. 5. In addition, the greater the relative maximum eccentricity Y to maximum eccentricity X, the greater the action of the lower portion of jaw 14. Also, by increasing the maximum eccentricity Y relative to X, the maximum size of the respective discharge openings between movable jaw 14 and stationary jaws 18, 20 are correspondingly increased. This in turn increases the rate which rock passes downwardly through the jaws and thereby increases the capacity of the rock crusher. Conversely, by decreasing the maximum eccentricity Y relative to X, the maximum size of the discharge opening is reduced. This results in finer crushed rock as the rock is positioned between the movable and stationary jaws a greater period of time before dropping through the discharge opening. One way of easily varying the maximum eccentricity Y relative to X is to substitute one set of bearings 50 and a new shaft 48 for the bearings and shaft installed in the crusher. More specifically, bearings 50 having an outer dimension equal to the dimension of sleeve 64 (explained below) and an inner dimension greater than the inner dimension of the installed bearings can be substituted for the installed bearings. Furthermore, a new shaft 48 can be installed with a greater maximum eccentricity Y and an outer dimension equal to the inner dimension of the new bearings 50. Hence, the relative maximum eccentricity Y to X is increased. Likewise, the relative maximum eccentricity Y to X can be varied by selecting the appropriate bearings.

Furthermore, with this arrangement crushing action occurs along the entire face of jaw 14. In addition, rock can be crushed in a pair of crushing cavities, one along each side of jaw 14.

JAWS

Figure 4:
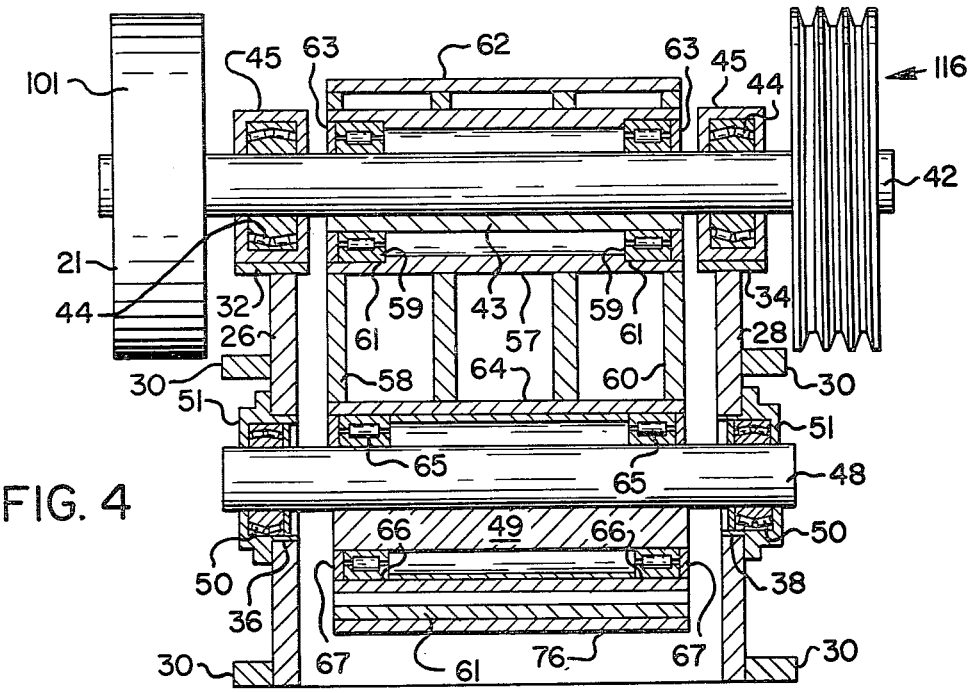
FIG. 4 is a vertical sectional view of the apparatus of the invention taken along lines 4—4 of FIG. 2.

With reference to FIGS. 2, 3 and 4, movable jaw 14 is generally upright and is held in place by shafts 42, 48 for crushing movement between stationary jaws 18, 20. Jaw 14 includes a main body 52 having a pair of spaced apart upright side face plate portions 54, 56, which extend transversely between upright front and rear plates 26, 28, front and rear plate portions 58, 60, a bottom plate portion 61 and a cap portion 62. Cap portion 62 joins the upper ends of side face portions 54, 56 and is of semicircular cross section to divert rock from hopper 12 downwardly along the side faces of the movable jaw 14. More specifically, the lower edges 67, 69 of cap portion 62 are generally horizontal and overlap the upper edges of respectively side face portions 54, 56 of the jaw. Also, for reasons explained below, edges 67, 69 are undercut.

As best seen in FIG. 4, an upper cylindrical sleeve 57 extends between plates 58, 60 with one end of the sleeve passing through an opening in plate 58 and the other end passing through an opening in plate 60. Sleeve 57 is secured to the outer surface of each plate as by welding. Camming porton 43, and therefore driven shaft 42, is journalled to sleeve 57 by bearings 59 positioned at the respective ends of the camming portion. Annular recesses or seats 61 are provided in the interior surface of sleeve 57 for these bearings and the bearings are each held in place and sealed within sleeve 57 by a respective oil seal member 63. Thus, sleeve 57 comprises a circular yoke for shaft 42 and its cam portion 43. In addition, the sleeve 57 together with seals 63 provide a dirt free chamber for cam portion 43. Shaft 42 can be removed by removing bolts 46, in the event of wear.

A cylindrical sleeve 64 extends between plates 58, 60 below shaft 42 and is secured to the outer surfaces of each plate as by welding. Thus, sleeve 64 provides a circular yoke for receiving cam shaft 48. That is, cam portion 49, and hence cam shaft 48, is journalled to cylindrical sleeve 64 by bearings 65 positioned at the respective ends of the camming portion. Annular recesses or bearing seats 66 are provided in the interior surface of sleeve 64 for these bearings and the bearings are each held in place and sealed within sleeve 64 by a respective oil seal member 67. As a result, sleeve 64 and oil seals 67 provide a dirt free chamber for camming portion 49.

Shafts 42, 48 cooperate to drive jaw 14 as explained below, and in general impart a substantially linear crushing motion to jaw 14.

A pair of oppositely facing crushing plates 70, 72 are mounted to the respective face plates 54, 56 of jaw body 52. The outer surface of each of these plates constitutes a generally upright crushing surface which extends transversely between front and rear wall plates 26, 28. As well known in the art, these crushing surfaces are apppropriately textured to produce the desired size of crushed material. For example, these surfaces may be smooth to produce finer rock. Crushing plates 70, 72 are releasably secured to side plates 54, 56 as follows. The upper ends of respective crushing plates 70, 72, are each beveled to wedge tightly against the undercut lower surface of the edges 67, 69 of cap portion 62. In addition, an upwardly opening generally U-shaped retaining or keeper plate 76 with upright legs 80, 82 is fastened to bottom plate 61. The upper end of each leg 80, 82 of keeper plate 76 is undercut to retain correspondingly beveled lower edges of crushing plates 70, 72 rigidly in place when keeper plate 76 is in position. Removal of the crushing plates can easily be accomplished by loosening the bolts holding retaining plate 76 in place. This facilitates their rapid replacement when they become worn.

Each stationary jaw 18, 20 is identical so that only jaw 18 will be described. Jaw 18 includes a rigid rectangular frame comprised of a top plate 84, bottom plate 86, face plate 88, a pair of side plates 90 (one shown in FIG. 3), and a cylindrical sleeve 91. Sleeve 91 extends transversely through jaw 18. Jaw 18 is supported by a pivot pin 92 which passes through sleeve 91. Cotter pins or other keepers are employed to prevent axial sliding of pin 92 from sleeve 91. Inward motion of jaw 18 toward jaw 14 is limited by an eye bolt 96 (FIG. 3). Bolt 96 is pivoted at one end 98 to a bracket 100 projecting from jaw 18 in a direction away from movable jaw 14. The other end 97 of bolt 96 is slidable through an opening in side panel 22. A nut 102 is secured to bolt end 99 exteriorly of panel 22 and limits the inward sliding of the bolt 96 and thereby limits inward motion of jaw 18 toward movable jaw 14.

An overload relieving toggle plate 104 is positioned between stationary jaw 18 and side wall panels 22 below bolt 96. One end of toggle plate 104 is loosely retained within a toggle plate seat 106 provided in the base of jaw 18. The other end of the toggle plate is retained in a seat 108 positioned between upper and lower retaining blocks 109, 111 mounted to the interior surface of side wall panel 22. Addition of shims, such as 113, between toggle plate seat 108 and side wall panel 22 reduces the distance between the lower end of stationary jaw 18 and movable 14 so that finer crushed rock is produced. Conversely, removal of shims increases this distance thereby causing the production of coarser rock. A bolt 115 holds seat 108 and shims 113 in place.

Preferably, the toggle plates are designed to break in the event pressure between the jaws exceeds a predetermined upper limit, such as when uncrushable material becomes lodged between the jaws. For example, the toggle plates may be of a brittle material such as cast iron. Breakage of the respective toggle plates enables the associated stationary jaw to pivot away from the movable jaw. As a result, material caught between the jaws is released before the crusher is damaged.

A crushing plate or wear plate 110, similar in shape to crushing plate 70, is secured to facing plate 88 in much the same manner as the crushing plate is secured to side plate 54. That is, wear plate 110 is wedged between an undercut retaining plate 112 spaced to bottom plate 86 and an undercut overhanging lip portion 114 of upper plate 84. Wear plate 110 provides a stationary crushing surface which may be textured in a conventional manner.

Thus, the wear plate 110 of each stationary jaw is disposed transversely between upright front and rear wall panels 26, 28 in opposed, spaced relation to substantially the entire expanse of an associated one of said crushing plates 70, 72. Each pair of opposed stationary and movable crushing surfaces converge downwardly in order to define, together with removable wear plates 99 (best seen in FIG. 3) mounted to the walls of the frame, a crushing cavity at each side of movable jaw.

The dual cam shaft rock crusher drive mechanism, shown in FIGS. 3 and 4, is designed to impact substantially linear or lateral motion to movable jaw 14 between stationary jaws 18, 20.

More specifically, cam shaft 42 is driven in rotation, such as by a prime mover coupled to the shaft by a belt drive assembly 116 shown in FIG. 2, to in turn drive eccentric or camming portion 43 mounted to the shaft 42. A balance or fly wheel 101 is mounted to the end of shaft 42 opposite drive assembly 116 to balance the drive assembly. Camming portion 43 in turn tends to impart gyratory motion to jaw 14.

Cam shaft 48 cooperates with cam shaft 42 to provide the desired motion of the movable jaw. With the maximum eccentricity Y of cam shaft 48 greater than the maximum eccentricity of cam shaft 42, cam shaft 48 oscillates about its axis as cam shaft 42 rotates. Consequently, although the upper half of the jaw moves in orbital fashion, the lower half moves linearly. That is, this motion of the lower portion of jaw 14 is substantially linear along the entire lower crushing face of jaw 14, and, in the illustrated embodiment, the motion is generally horizontal.

Although other alignments are suitable, in the form illustrated in FIGS. 1-4, the axes of shafts 42 and 48 are in a common vertical plane. Furthermore, in the illustrated starting position, the widest portion of the cam shafts 42, 48 are positioned on the same vertical line.

DESCRIPTION OF SECOND PREFERRED EMBODIMENT

Figure 6:
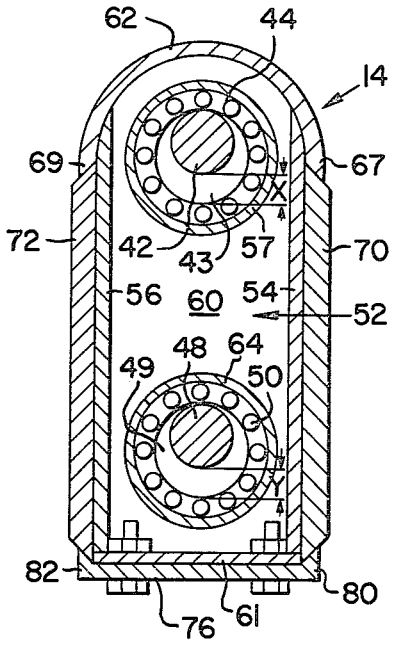
FIG. 6 is a vertical sectional view of another embodiment of the present invention employing dual cam shafts of the same maximum eccentricity.
Figure 7:
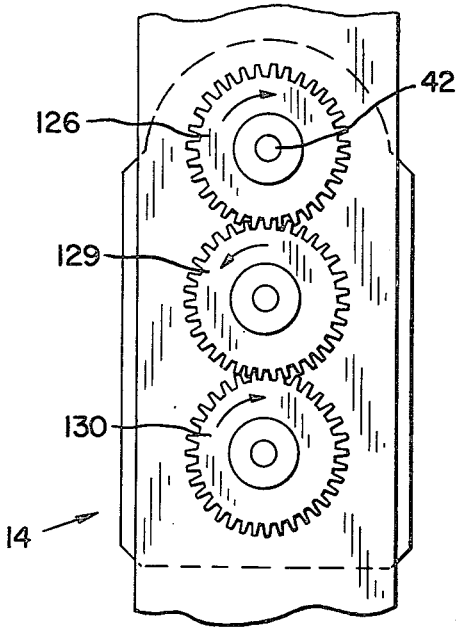
FIG. 7 is an elevational view of a portion of the rock crusher of FIG. 6.

Looking at FIGS. 6 and 7, a second embodiment of the invention is illustrated. This embodiment is identical with the previously described FIG. 1 embodiment except that the maximum eccentricity X of cam shaft 47 is equal to the maximum eccentricity Y of cam shaft 48. In addition, cam shaft 48 is synchronized, in this case by a gear mechanism, to rotate with shaft 42.

In this latter embodiment, shaft 42 is driven as explained above. In addition, a gear 126 mounted to shaft 42 at the front of the crusher engages, through an intermediate gear 129 pivoted to the crusher frame, a similar gear 130 connected to shaft 48. Consequently, shafts 42 and 48 rotate together, as in the direction indicated by the arrows, to produce the crushing motion.

With this dual eccentric drive arrangement, movable jaw 14 has a crushing action somewhat more orbital than in the FIGS. 1–4 embodiment, but nevertheless accomplishes crushing action with a minimal number of moving parts.

OPERATION OF DRIVE MECHANISM

Figure 5:
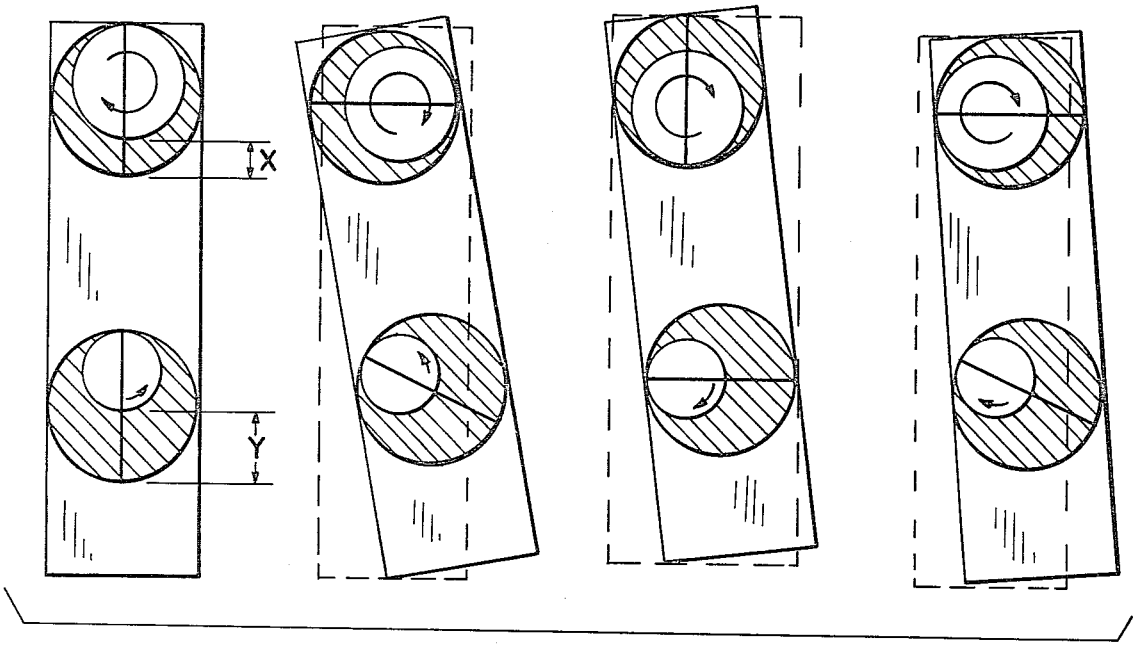
FIG. 5 is a schematic diagram of the operation of a drive mechanism in accordance with the present invention.

Referring to FIG. 5, the movement of the movable jaw of the crusher of FIGS. 1–4 will be explained in greater detail. From its starting position shown to the far left in FIG. 5, and with the illustrated distance between shafts 42, 48, relative shaft and cam sizes, and relative maximum eccentricities X and Y, rotation of shaft 42 clockwise through ninety degrees moves oscillating shaft 48 counterclockwise (upwardly) approximately seventy degrees. As rotation of shaft 42 continues through an additional ninety degrees oscillating shaft 48 continues its counterclockwise motion through approximately ninety degrees from its starting position. Also, rotation of shaft 42 through an additional one hundred and eighty degrees, to its starting position, causes clockwise movement of shaft 42 through ninety degrees to its starting position as well. Thereafter, the cycle is repeated. This movement of oscillating shaft 48 imparts substantially linear motion to the lower portion of jaw 14.

It should be noted that the starting positions of shafts 42, 48 can be other than as illustrated in FIG. 5. Also, the oscillating shaft 48 can move in the same direction, clockwise or counterclockwise, during the first one hundred and eighty degrees of motion of the driven shaft 42 and then back in the opposite direction from the driven shaft as the drive shaft continues its movement through three hundred and sixty degrees to its starting position. In addition, the camming portion of the oscillating shaft 48 can be positioned in any of the four quadrants of a circle in its starting position and still produce the same movement in movable jaw 14. Also, the driven shaft 42 can be rotated either clockwise or counterclockwise to produce the same action in jaw 14.

It should be noted that many variations of my invention are possible, but all include at least two cam shaft means. For example, driven cam shaft 42 can be positioned below cam shaft 48 in the embodiment of FIGS. 1–4. In addition, the cam shafts need not be positioned in a vertical plane, but can be located at other locations in the movable jaw, such as to suspend the jaw for motion other than between one or more upright stationary jaws. Also, the bearings supporting the cam shafts can, of course, be arranged in different positions. Furthermore, the invention is, of course, not limited to the illustrated form of roller bearings, for example, bronze bushings or other forms of roller bearings may be used.

Having illustrated and described the principles of my invention with reference to several preferred embodiments, it should be apparent to those persons skilled in the art that such invention may be modified in arrangement and detail without departing from such principles. I claim as my invention all such modifications as come within the true spirit and scope of the following claims:

I claim:

1. A rocker crusher comprising:

a movable jaw; a stationary jaw; and a drive mechanism including rotatable drive cam shaft means extending transversely through and mechanically coupled to the movable jaw and oscillating cam shaft means extending transversely through and mechanically coupled to the movable jaw.

2. A drive mechanism for a rock crusher with a movable jaw and a stationary jaw comprising:

first rotatable eccentric shaft means coupled to such a movable jaw, said first eccentric shaft means having a maximum eccentricity of a first dimension and being adapted for driving in rotation; and second floating eccentric shaft means coupled to said movable jaw, said second eccentric shaft means having a maximum eccentricity of a second dimension greater than the first dimension such that the second eccentric shaft means oscillates when the first shaft means rotates to impart reciprocating motion to the movable jaw.

3. A drive mechanism according to claim 2 including means for rotating said first shaft means.

4. A drive mechanism according to claim 2 in which each of said shaft means are journalled to and surrounded at least partially by said movable jaw.

5. A rock crusher comprising:

a frame, said frame including a pair of upright spaced apart frame walls;

at least one stationary jaw extending transversely between said frame walls;

a generally upright movable jaw suspended between said upright frame walls of reciprocating movement toward and away from said stationary jaw, said movable jaw including first and second spaced apart wall portions which define respective first and second spaced apart chambers each extending at least partially through the movable jaw along a transverse axis between the frame walls; and drive means for reciprocating said movable jaw toward and away from said stationary jaw to crush rock between the jaws, said drive means including first rotatable cam shaft means journalled to said first wall portion, having a maximum eccentricity of a first dimension, and positioned at least partially within said first chamber, said drive means also including second cam shaft means journalled to said second wall portion having a maximum eccentricity of a second dimension equal to the first dimension, and positioned at least partially in the second chamber, such that said second cam shaft means oscillates and said movable jaw reciprocates when said first cam shaft means rotates; and also including synchronizing means for mechanically coupling said first and second shaft means such that they rotate together when one of said shafts is rotated.

6. A drive mechanism according to claim 5 in which said synchronizing means comprises a first gear mounted to said first shaft means, a second gear mounted to said second shaft means and a third gear engaging said first and second gears for transferring motion between said first and second gears such that the first and second shaft means rotate together in the same direction.

7. A rock crusher comprising:

a frame, said frame including a pair of upright spaced apart frame walls;

at least one stationary jaw extending transversely between said frame walls;

a generally upright movable jaw suspended between said upright frame walls for reciprocating movement toward and away from said stationary jaw, said movable jaw including first and second spaced apart wall portions which define respective first and second spaced apart chambers each extending at least partially through the movable jaw along a transverse axis between the frame walls; and drive means for reciprocating said movable jaw toward and away from said stationary jaw to crush rock between the jaws, said drive means including first rotatable cam shaft means journalled to said first wall portion, having a maximum eccentricity of a first dimension, and positioned at least partially within said first chamber, said drive means also including second cam shaft means journalled to said second wall portion having a maximum eccentricity of a second dimension greater than the first dimension, and positioned at least partially in the second chamber, such that said second cam shaft means oscillates and said movable jaw reciprocates when said first cam shaft means rotates.

8. A rock crusher according to claim 7 in which said wall portions are cylindrical and said first and second chambers are of cylindrical cross section.

9. A rock crusher according to claim 7 in which said first and second chambers extend transversely through the movable jaw, said first cam shaft means including a drive shaft extending through said first chamber and pivoted at one end portion to one of said frame walls and pivoted at the other end portion to the other of said frame walls, said drive shaft including a first camming portion positioned within said first chamber and journalled to said first wall portion, and in which said second cam shaft means includes an oscillating shaft extending through said second chamber and pivoted at one end portion to one of said frame walls and pivoted at the other end portion to the other of said frame walls, said oscillating shaft including a second camming portion positioned within said second chamber and journalled to said second wall portion, the second camming portion having a maximum eccentricity which is greater than the maximum eccentricity of the first camming portion such that said oscillating shaft oscillates as the first drive shaft rotates, and also including means for rotating said drive shaft to reciprocate said movable jaw.

10. A rock crusher according to claim 9 in which the axes of said drive shaft and of said oscillating shaft are in a common vertical plane.

11. A rock crusher according to claim 9 including flywheel means mounted to said drive shaft for balancing the rotation of said drive shaft about its axis.

12. A rock crusher according to claim 9 in which said drive shaft is above said oscillating shaft.

13. A rock crusher comprising:

a frame, said frame including a pair of upright spaced apart frame walls;

a pair of stationary jaws extending transversely between said frame walls;

a drive shaft extending transversely between an upper portion of said frame walls and pivoted at one end portion to one of said frame walls and at its other end portion to the other of said frame walls, said drive shaft including a first cylindrical camming portion;

an oscillating shaft extending transversely between a lower portion of said frame walls and pivoted to one end portion to one of said frame walls and pivoted at its other end portion to another of said frame walls, said oscillating shaft including a second cylindrical camming portion of a greater maximum eccentricity than the maximum eccentricity of the first camming portion;

a generally upright movable jaw mounted to said drive shaft and to said oscillating shaft between said frame walls for reciprocating movement between the stationary jaws, a rock crushing cavity being defined between each of said stationary jaws and the movable jaw, said movable jaw including respective upper and lower first and second cylindrical chamber defining sleeves extending transversely through said movable jaw so as to define first and second chambers of circular cross section;

said drive shaft extending through said first chamber with said first camming portion being journalled to said first chamber defining sleeve;

said oscillating shaft extending through said second chamber with said second camming portion being journalled to said second chamber defining sleeve; and means for rotating said drive shaft thereby oscillating said oscillating shaft and moving said movable jaw between said stationary jaws to crush rock in each rock crushing cavity.

14. A rock crusher according to claim 13 including roller bearings for journalling said drive shaft to said first chamber defining sleeve and roller bearings for journalling said oscillating shaft to said second chamber defining sleeve.

15. A rock crusher according to claim 13 in which said drive shaft includes a first end portion projecting outwardly from one of said frame walls and a second end portion projecting outwardly from the other of said frame walls, said rock crusher including drive means coupled to said first end portion for rotating said drive shaft and balance means coupled to said second end portion for balancing the rotation of said drive shaft.

16. A rock crusher according to claim 13 in which said frame walls each include an upper bearing mounting bracket, said rock crusher including upper bearings mounted to each of said mounting brackets for pivoting the respective ends of the drive shaft to the frame walls, said frame walls each including laterally opposed generally horizontal elongated slots through which the respective ends of the oscillating shaft extend, said rock crusher including lower bearings mounted to said frame walls for pivoting the respective ends of the oscillating shaft to the frame walls, said slots being sized such that when said upper and lower bearings are released from the frame walls the movable jaw can be turned about a vertical axis a sufficient distance to position the ends of the oscillating shaft interiorly of the frame walls thereby permitting upward lifting of the movable jaw away from the frame of the crusher.

* * * * *

UNITED STATES PATENT AND TRADEMARK OFFICE

CERTIFICATE OF CORRECTION

PATENT NO. : 4,382,560

DATED : May 10, 1983

INVENTOR(S) : Nicolle A. Toole

It is certified that error appears in the above-identified patent and that said Letters Patent is hereby corrected as shown below:

References Cited: "Bogle" should be --Bogie--.

"Hicker" should be --Hicken--.

Column 1, line 23 - "constrast" should be --contrast--.

line 28 - "mechanism" should be --mechanisms--.

Column 3, line 34 - "From" should be --Frame--.

Column 4, line 55 - "respectively" should be --respective--.

line 63 - "porton" should be --portion--.

Column 6, line 4 - after "movable" insert --jaw--.

line 21 - "spaced" should be --secured--.

line 34 - after "of" insert --the--.

line 36 - "impact" should be --impart--.

UNITED STATES PATENT AND TRADEMARK OFFICE

CERTIFICATE OF CORRECTION

PATENT NO. : 4,382,560

DATED : May 10, 1983

INVENTOR(S) : Nicolle A. Toole

It is certified that error appears in the above-identified patent and that said Letters Patent is hereby corrected as shown below:

Column 7, line 1 - "47" should be --42--.

Column 8, line 38 - "of" should be --for--.

Column 10, line 10- "to" should be --at--.

Signed and Sealed this

Thirteenth Day of December 1983

[SEAL]

*Attest:*

GERALD J. MOSSINGHOFF

*Attesting Officer*

*Commissioner of Patents and Trademarks*